US005396671A

United States Patent [19]

Stacy

[11] Patent Number: 5,396,671

[45] Date of Patent: Mar. 14, 1995

[54] PAD FOR GENERATING ALTERNATING PRESSURE

[76] Inventor: Peter C. Stacy, 2 Carol Avenue, Bromsgrove Worcestershire, Great Britain, B61 8RN

[21] Appl. No.: 97,139

[22] Filed: Jul. 26, 1993

[30] Foreign Application Priority Data

May 23, 1993 [GB] United Kingdom ..... 9311069

[51] Int. Cl.[6] ..... A61G 7/04

[52] U.S. Cl. ..... 5/455; 5/449; 5/453; 297/DIG. 3; 601/148

[58] Field of Search ..... 5/449, 453, 455, 456; 297/DIG. 3; 601/5, 24, 26, 148, 150

[56] References Cited

U.S. PATENT DOCUMENTS

| | | | |
|---|---|---|---|
| 3,297,023 | 1/1967 | Foley | 5/453 X |
| 3,595,223 | 7/1971 | Castagna | 5/453 X |
| 3,678,520 | 7/1972 | Evans | 5/453 |
| 3,701,173 | 10/1972 | Whitney | 5/453 |
| 3,740,777 | 6/1973 | Dee | 5/453 |
| 4,193,149 | 3/1980 | Welch | 5/453 X |
| 4,267,611 | 5/1981 | Agulnick | 5/453 |
| 4,391,009 | 7/1983 | Schild et al. | 5/453 |
| 4,694,520 | 9/1987 | Paul et al. | 5/453 |
| 4,777,679 | 10/1988 | DeLooper | 5/453 |
| 4,803,744 | 2/1989 | Peck et al. | 5/453 |

*Primary Examiner*—Michael F. Trettel

*Attorney, Agent, or Firm*—Caesar, Rivise, Bernstein, Cohen & Pokotilow, Ltd.

[57] ABSTRACT

A pad for providing alternating pressure e.g. in a mattress. The pad comprises first and second flexible longitudinal tubes adjacent respective first and second sides of the pad. The pad also includes a plurality of first transverse tubes communicating pneumatically with the first longitudinal tube and each having a closed end remote therefrom and a plurality of second transverse tubes communicating pneumatically with the second longitudinal tube and each having a closed end remote therefrom. The first tubes are disposed at a first angle such that the closed ends of the first transverse tubes are located beneath the second longitudinal tube. The closed ends of the second transverse tubes are disposed at a second angle opposive to the first angle and are located beneath the first longitudinal tube. The first and second tubes are interdigitated so that the arrangement produces a shallow "V".

10 Claims, 5 Drawing Sheets

PAD FOR GENERATING ALTERNATING PRESSURE

CROSS-REFERENCES TO RELATED APPLICATIONS

Applicant claims the benefit of the priority under 35 U.S.C. § 119 of copending Great British Application 9311069.0, filed May 23, 1993.

BACKGROUND OF THE INVENTION

Field of the Invention

The invention relates to a pad arranged to generate alternating pressure, especially for use by sedentary patients, e.g. bed-ridden patients. Such pads may take various forms including mattresses and beds and other forms as explained later. For convenience the invention will first be described with reference to use in a mattress or bed.

SUMMARY OF THE INVENTION

Alternating pressure beds have been developed for patients who are prone to bed sores, for example, by being unable to move. Basically the bed comprises a mattress which has two sets of chambers interspaced with one another, a pump and control apparatus for alternately inflating and at least partially deflating the chambers of one set, while simultaneously alternately at least partially deflating and inflating the chambers of the other set. The alternation of inflation and deflation prevents pressure from causing sores and like problems to the skin of the patient and encourages blood circulation.

In accordance with one aspect of the invention, there is provided a pad for use in alternating pressure, the pad comprising: first and second flexible longitudinal tubes adjacent respective first and second sides of the pad; a plurality of first transverse tubes communicating pneumatically with the first longitudinal tube and having a closed end remote therefrom; and a plurality of second transverse tubes communicating pneumatically with the second longitudinal tube and having closed ends remote therefrom, the first tubes being interwoven with the second tubes such that the closed ends of the first transverse tubes are located beneath the second longitudinal tube, and the closed ends of the second transverse tubes are located beneath the first longitudinal tube.

A pad of the invention when incorporated in a mattress keeps a patient more comfortable since the arrangement produces a shallow "V" between the first and second transverse tubes which has two functions: i) it spreads the contact round the patient more than would be in the case prior art mattresses which are, essentially, flat; and ll) it helps prevent the patient rolling off the bed.

In the case of a pad in a mattress, two layers of tho first and second longitudinal and transverse tubes are preferably arranged one above the other so that each first tube in the upper layer lies directly over a respective second tube in the lower layer and each second tube in the upper layer lies directly over a first tube in the lower layer. This arrangement ensures that the pressure of contact between the patient and the mattress alternates as required, but also ensures that deflation of a tube does not allow the patient to come into contact with the surface under the mattress, and that deflation of one longitudinal tube with its transverse tube, does not tip the patient out of bed on that side.

It is a much preferred feature of the invention that the tree ends of the transverse tubes be of relatively larger area e.g. hammer head shape to provide support at the sides of the pads. As a result, irrespective of whether the tubes of which layer are being deflated there will always be support at the margins of the pad.

In a convenient form, each set of longitudinal and transverse tubes is made from two layers of flexible plastics sheet welded together round their periphery. In that form, a marginal flap is conveniently formed in the plastics sheets along each longitudinal tube remote from its transverse tubes, and a respective terminal flap is formed in the plastics sheets at the end of each transverse tube remote from its longitudinal tube, the terminal flaps of each first transverse tube being secured to the marginal flap of the second longitudinal tube and the terminal flaps of each second transverse tube being secured to the marginal flap of the first tube.

The transverse tubes preferably have the same cross-sectional dimension as the longitudinal tubes.

This aspect of the invention also extends to an alternating pressure bed, in which the mattress is combined with pump means communicating with the first and second longitudinal tubes, to inflate and at least partially deflate the first longitudinal and transverse tubes alternately and, synchronously therewith, to deflate at least partially and to inflate the second longitudinal and transverse tubes. The pump means will be associated with control means to control the inflation and deflation as explained below, including pressure regulating meand and alarm means.

In accordance with another aspect of the invention there is provided a mattress for an alternating pressure bed, comprising an array of a plurality of first chambers interspaced with a plurality of second chambers, the first and second chambers being inflatable and at least partly deflatable alternately, the mattress including a pressure sensitive means located beneath the array of chambers. It is preferred that there is a pressure sensitive means for each layer, the means being offset from each other.

Normally the pressure to which the chambers of an alternating pressure bed are inflated is set by the nurse or doctor to a value reflecting the weight of the patient, with the intention that the pressure is not too high, in which case the bed would be hard and uncomfortable, and not too low, in which the patient would make contact with, or press directly against the surface beneath the mattress. It is not normal to weigh the patient for this purpose. The weight is usually guessed at. We have found that the ability of people to guess the weight of others is open to large errors which, clearly, load to discomfort for the patient. The pressure sensitive means of this invention regulates the inflation according to the weight of the patient, which may be concentrated e.g. when sitting.

Preferably the pressure sensitive means comprises a sealed body having an air path, pressurised air being supplied to the air path, and means to direct the pressurised air from the air path to the chambers in the event of a constriction in the air path. Preferably a pipe leads from the air path out of the body to the exterior of the body. Most preferably the outlets lead to a common exit conduit. This has the advantage that when the pad is disconnected from the pump means, the air supply pipelines (which preferably include a pressure monitor means), may be connected to the exit conduit. As a result the system becomes a self-controlling closed circuit and will continue to alternate pressure which however will increase.

In addition the pad of the invention is useful in another context. There is a general need to move a patient out of bed for exercise and pressure relief. Unfortunately not enough nursing staff is available to walk or otherwise exercise the patient and as a result the patient suffers. It is another object of this invention to solve that problem.

In another aspect the invention provides a pad for use by patients sitting in a chair, the pad comprising a seat portion and a back portion to overlie the seat and back portion of the chair respectively, the pad containing two sets of chambers interspaced with one another, in association with a pump and control apparatus for alternately inflating and at least partially deflating the chambers of one set while simultaneously alternately at least partly deflating the chambers of the other set.

Preferably the seat portion has a different size of chamber or chambers from that of the back portion because greater pressure and/or alternation of pressure will be required in the seat region. Most preferably the seat region of the pad comprises first and second flexible longitudinal tubes adjacent respective first and second sides of the pad; a plurality of first transverse tubes communicating pneumatically with the first longitudinal tube and having a closed end remote therefrom; and a plurailty of second transverse tubes communicating pneumatically with the second longitudinal tube and having closed ends remote therefrom, the first tubes being interwoven with the second tubes such that the closed ends of the first transverse tubes are located beneath the second longitudinal tube, and the closed ends of the second transverse tubes are located beneath the first longitudinal tube.

In one preferred embodiment the tubes of the seat portion are of wider diameter than those of the back portion although the air pressure will be substantially the same in the tubes.

In a convenient form, each set of longitudinal and transverse tubes is made from two layers of flexible plastics sheet welded together round their poriphery. Preferably the plastics sheet is a high frequency weldable polyurethane. A marginal flap is conveniently formed in the plastics sheet along each longitudinal tube remote from its transverse tubes, and a respective terminal flap is formed in the plastics sheets at the end of each transverse tube remote from its longitudinal tube, the terminal flaps of each first transverse tube being secured to the marginal flap of the second longitudinal tube and the terminal flaps of each second transverse tube being secured to the marginal flap of the first tube.

While it is usual to have one or more layers of the tubes in a mattress, in the case of a pad for a chair it is preferred to have a single layer only.

Preferably the pad includes side portions to overlie arm rests of the chair. These side portions may be integrally formed with the back seat portions but preferably they are separate. A leg portion may also be provided.

The pad may include straps or the like to overlie the back of the chair to hold the pad in place.

The pad may be pressurised using the pump and control apparatus provided for an alternating pressure bed. In this way the capital requirements for a hospital, nursing home or like establishment are minimized. For reasons of cost it is preferred to have a pump of a low rating, i.e. which will deliver say 5 or more liters of air per minute in the region of 1 to 1.5 pei.

BRIEF DESCRIPTION OF THE DRAWING

In order that the invention may be well understood it will now be described by way of example only with reference to the embodiments shown in the accompanying diagrammatic drawings, in which.

DESCRIPTION OF THE PREFERRED EMBODIMENTS

Figure 1:
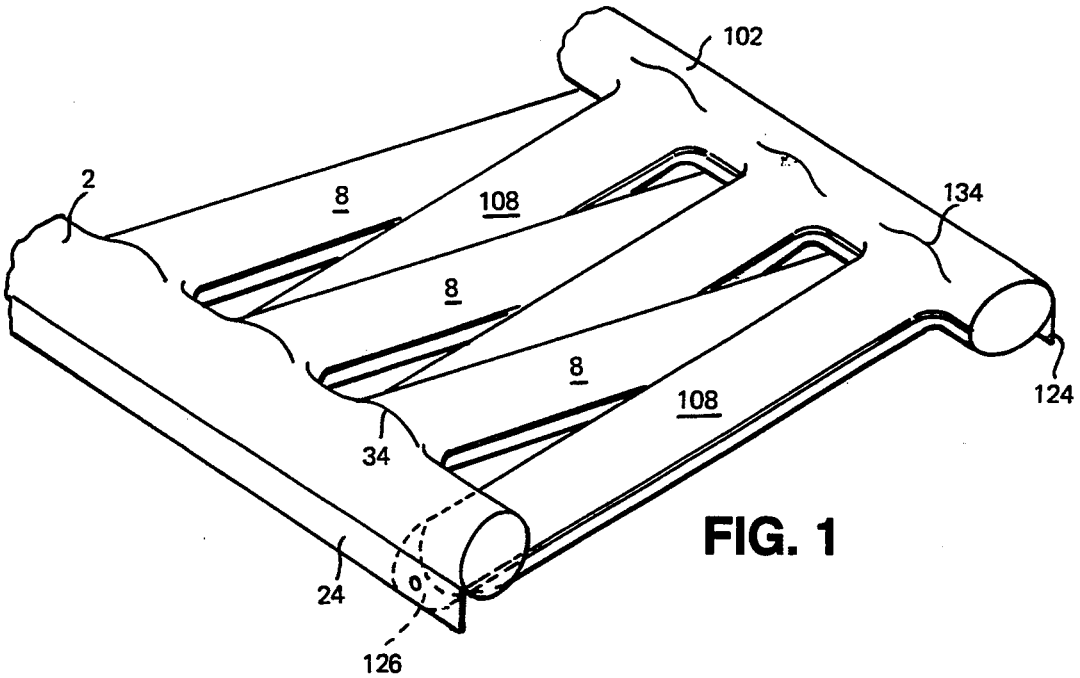
FIG. 1 is a perspective view at one arrangement of tubes for a mattress embodying one aspect of the invention.

Referring to the embodiment of FIGS. 1 to 7, a first tube 2 extends longitudinally down one edge of a mattress 4 inside a cover 6. A plurality of tubes 8 project at equal intervals from the tube 2, generally at right angles thereto. The arrangement of tubes 2 and 8 is made by welding the edges of two suitably shaped sheets of flexible plastics sheet along weld lines 10 so that the tubes 8 communicate pneumatically with the tube 2. The tube 2 is divided into two sections 12 and 14 by a further weld line 16, as will be explained. If pneumatic pressure is applied to the sections 12 and 14 via respective tubular connectors 20 and 22, the sections 12 and 14 will inflate with the respective transverse tubes 8 connected thereto. Similarly, if the pressure via the connectors 20 and 22 is relieved, the sections 12 and 14 deflate with the respective transverse tubes 8.

Figure 2:
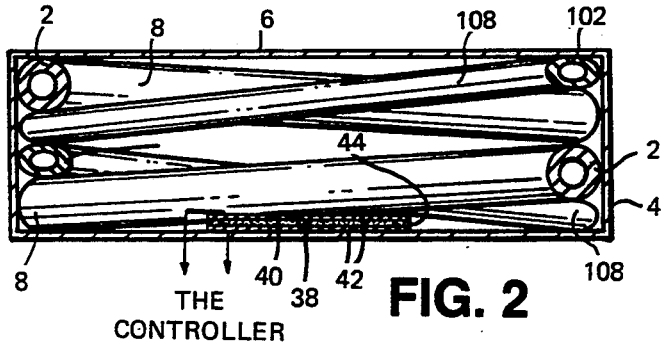
FIG. 2 is a cross section of a mattress invention utilizing the arrangement of FIG. 1.
Figure 3:
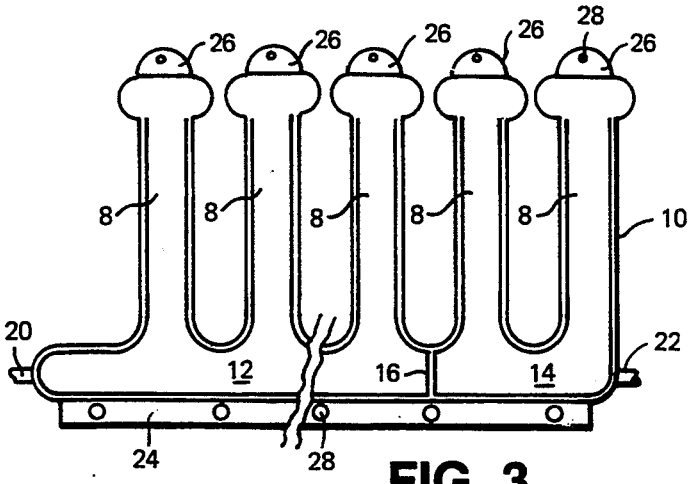
FIG. 3 is a detail showing one set of tubes from the arrangement of FIG. 1.
Figure 4:
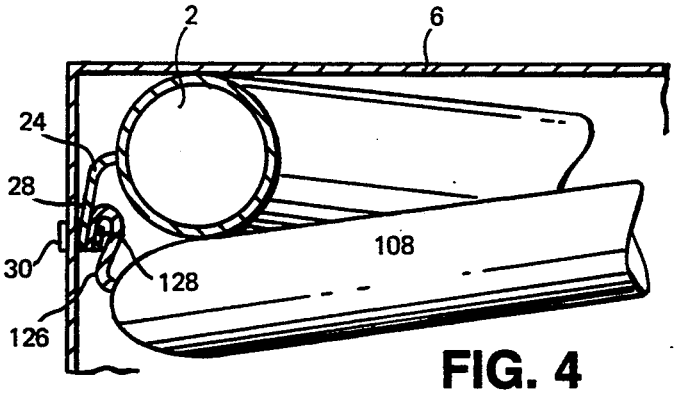
FIG. 4 is a cross sectional detail of the mattress of FIG. 2.
Figure 5:
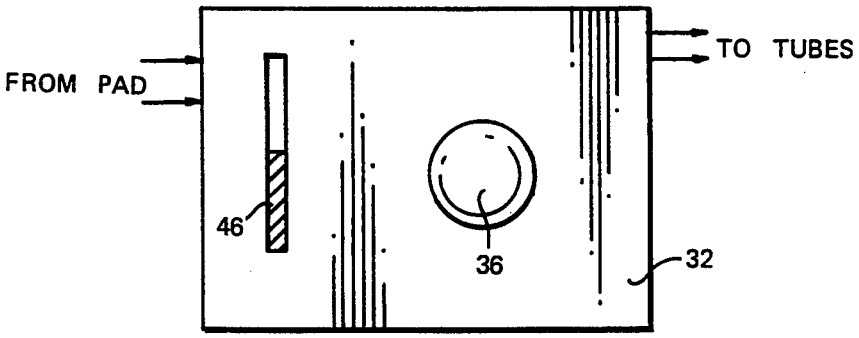
FIG. 5 shows apparatus for inflating and controlling the pressure in the mattress of FIG. 2.

The sheets from which the tubes are formed are ϵo shaped and welded as to form a flap 24 along the margin of the tube 2 remote from the tubes 8. The sheets are also so shaped and welded as to provide a terminal flap 26 at the closed end of each transverse tube 8. Press fasteners 28 are provided on the flaps 24 and 26 so that two of the arrangements shown in FIG. 3 may be interwoven as illustrated in FIGS. 1, 2 and 4. Thus, a second arrangement re-oriented by rotating FIG. 3 through 180 degrees in the plane of the paper has its transverse tubes 108 interspaced with the transverse tubes 8 as illustrated in FIG. 1. In the second arrangement, features corresponding to those of the first arrangement shown in FIG. 3, are identified by a reference number formed by adding 100 to the number used in FIG. 3. As may be seen from the drawings, the second transverse tube 108 pass beneath the first longitudinal tube 2. Referring to FIG. 4, the terminal flap 126 at the end of each second transverse tube 108 is secured to the marginal flap 24 of the first longitudinal tube 2 by means of corresponding press fasteners 28 and 128. The marginal flap 24 is secured to the cover 6 by further press fasteners 30.

The transverse tubes 8 pass beneath and are secured to the longitudinal tube 102 in a similar manner.

As may be seen from FIGS. 1 and 2, the arrangement produces a shallow "V" shape between the transverse tubes 8 and 108. Since this wraps round the patient rather more than the flat beds of the prior art, it spreads the contact area so reducing the pressure and increasing the patient's comfort. The "V" shaped arrangement also assists in preventing the patient from falling out of bed. I believe that the interdigitation of the transverse tubes 8 and 108 is a unique feature of the invention.

Referring to FIG. 3, the welds 18 in the two longitudinal tubes 2 and 102 (only one is illustrated in FIG. 3) are spaced a short distance from the same end of the bed so that the pressure applied under the feet may be reduced compared to that applied under the head and trunk of the patient. FIG. 3 also showns that the tubes 8 and 108 have expanded free ends 8A. This produces a bulge along each side of the pad in each layer, and ensures that sufficient pressurised air is present in the intiated layer while the other layer is being deflated that the overall shape is not compromised.

The tubular connectors 20 and 22 connect the sections 12 and 14 of the longitudinal tube 2 to a pump and control unit 32. The corresponding sections of the second longitudinal tube 102 are similarly connected to the pump and control unit. Pneumatic pressure produced by a pump (not illustrated separately) is alternately applied via the connectors 20 and 22 to the longitudinal tube 2 and then relieved so alternately inflating and deflating the tube 2 and the transverse tubes 8 connected thereto. In synchronism with that, the controller alternately relieves pressure in and applies pressure to the longitudinal tube 102 and connected transverse tubes 108. The pump is selected to deliver pressurised air at a relatively fast flow rate. FIG. 2 illustrates the cycle at the stage when the first longitudinal tube 2 and the first transverse tubes 8 are inflated and the second longitudinal tube 102 and second transverse tubes 108 have been partially deflated compared to the tubes 2 and 8.

As may also be seen in FIG. 2, another layer of tubes 2, 8, 102, 108 is situated beneath the first so that the first tubes 2 and 8 in the upper layer are located directly over corresponding second tubes 102 and 108 in the lower layer. Similarly, the second tubes 102 and 108 in the upper layer are located directly over the first tubes 2 and 8 in the lower layer. This arrangement ensures that when one set of tubes is deflated, the tube set directly beneath is deflated also so that the patient cannot bear directly on the surface beneath the mattress but only through an inflated tube. The arrangement also ensures that there is always an inflated longitudinal tube down each side of the mattress, so there is no danger that deflating one of the tubes 2 or 102 will tip the patient out of bed.

The transverse tubes 8 and 108 are of the same diameter as the longitudinal tubes 2 and 102. (They can of course be of the larger or smaller diameter).

Figure 6:
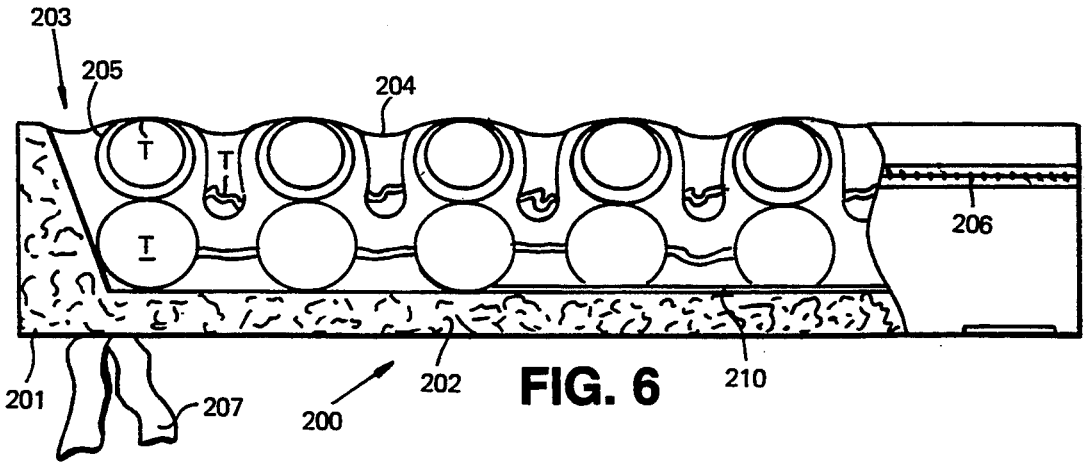
FIG. 6 is a side elevation of another embodiment of mattress.
Figure 7:
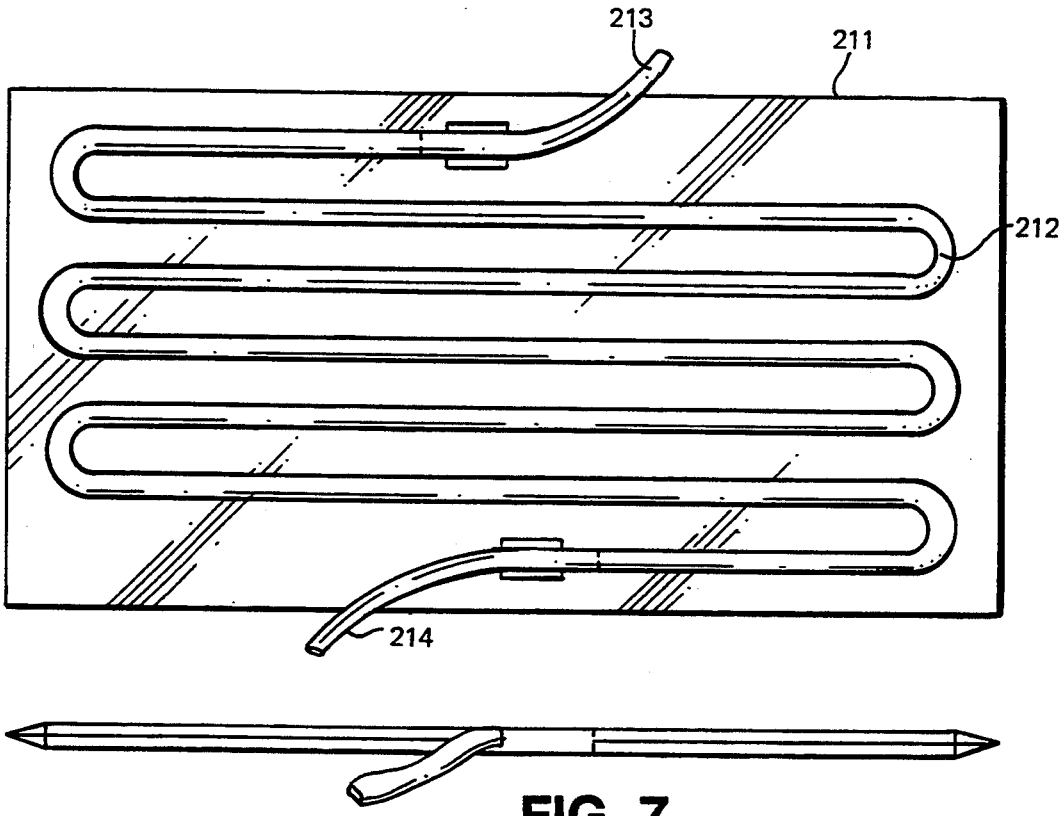
FIG. 7 is a plan view of the pressure regulating mat in the mattress of FIG. 6.
Figure 8:
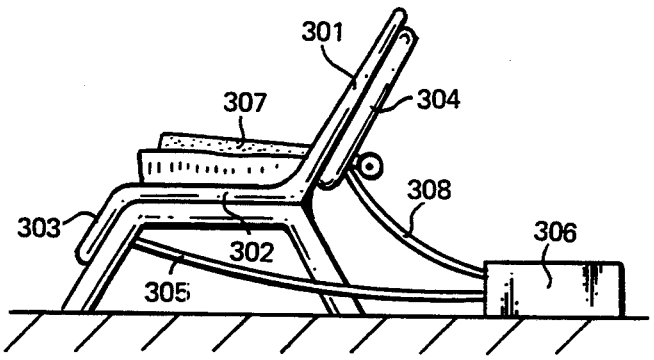
FIG. 8 is a side elevation, partly in section, of a day chair including a pad of the invention.
Figure 9:
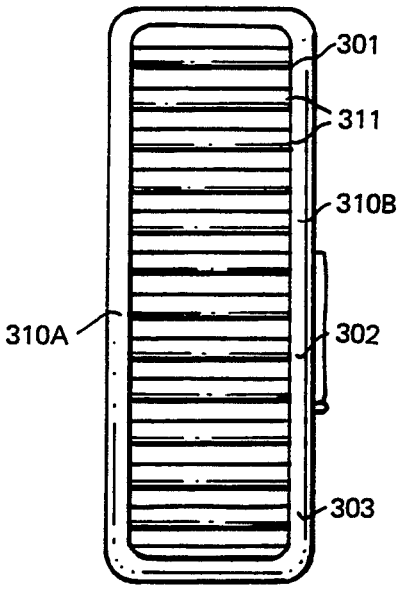
FIG. 9 is a plan view of the pad of FIG. 8, the cover having been removed.

The mattress 200 of FIGS. 6 and 7 comprises a base 201 comprising a foam surround 202 defining a chamber 203 to receive the tubes. The mattress has a cover 204 of fabric or the like, to cover the surround and define the roof to the chamber. As shown in FIG. 6, the alternate tubes are inflated and deflated. The cover has a zip closure 206 and straps 207. e.g. of VELCRO (trade mark) a material comprising a plurality of releasably interlocking hooks and loops, by which it may be attached to a support not shown.

A pressure regulating mat 210 is present between the lower tubes and the floor of the chamber 203 and is shown in plan view in FIG. 7. The mat comprises a sealed generally rectangular body 211 through which is looped an elongate air pathway 212 or pipe. At one end 213 the pipe is connected to the pump 32; the other end 214 extends beyond the mat. Air is pumped under pressure through the mat, and can escape into the sealed chamber as well as into the mattress chamber itself and from there to the ambient atmosphere. If a patient is bearing down too heavily on the mattress, e.g. when sitting up, the flow of air through the pipe will be restricted, if not cease, and air will then be directed to flow into the tubes. The air pressure in the tubes will then increase until the weight is lifted off the path so allowing the air to flow through again. As a result a sore producing pressure point is less likely to build up.

It is preferred feature that a pressure sensitive mat be present for each inflation chamber. The air is released to atmosphere via a conduit common to both air paths which include shut off valves. If the mattress is disconnected from the pump and the supply teedlines are connected to that conduit a closed system will be created, so that air will be retained evenly distributed in the mattress. If the exit conduit and the control means are connected with the pump running the mat will increase in pressure so actuating an alarm to indicate that the air is not returning to the control means.

The pad shown in the embodiment of FIGS. 8 to 13 comprises an elongate cover 307 defining a back portion 301, a seat portion 302, and a leg support portion 303. The portions are dimensioned to fit inside these of a day seat or armchair, C, part of which is shown. The cover is formed of a wear resistant moisture impervious material typically a plastics. The portions may be individual portions within one overall cover, although it is within the scope of the invention to provide separate portions joined together in side by side relation, e.g. using VELCRO, clips or the like. The pad is anchored to the chair C by means of straps 304 some of which are shown. A gap is usually present between the back portion and the seat portion of a hospital day chair and the straps may be wound through the gap and about the back portion. The seat portion of the pad may have a floor to rest on the chair seat.

The cover contains a network of inflatable/deflatable pneumatic chambers connected by air hoses 305 to a pump unit 306 incorporating suitable controls. A representative network is shown in FIGS. 8, 9, 10 and 11.

The chambers are made up of main tubes and branch tubes. Main tubes 310A, 310B, extend longitudinally down each side of the pad. A number of respective branch tubes 311A, 311B project at spaced apart equal intervals from the main tubes 10, generally at right angles thereto. The tubes 310 and 311 are integrally formed by welding the edges of two suitably shaped sheets of flexible but pressure resistant plastics sheet along weld lines so that the side tubes 311 communicate pneumatically with the respective main tube 310. The free ends 312 of the transverse tubes are of greater width than the remainder which has the effect of adding rigidity at the sides, preventing torsional movement of the tubes and allowing a higher pressure at the sides. A connector 313 is welded to one of the branch tubes of each chamber, as shown. Pneumatic pressure applied to the tubes 310 via the respective connectors 313, will cause the main tube and the respective side tubes 311 to inflate. Similarly, if the pressure is relieved via the connectors 313 the main tube 310 and the side tubes 311 will deflate.

Figure 10:
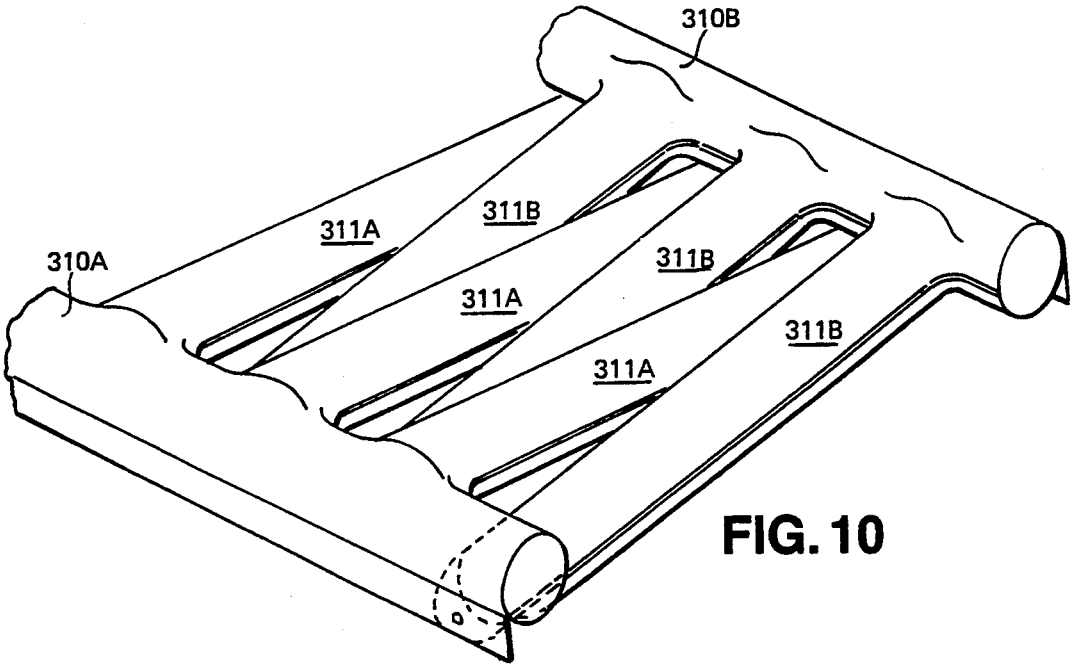
FIG. 10 is a perspective view of one arrangement of tubes for a portion of the pad of FIG. 8.
Figure 11:
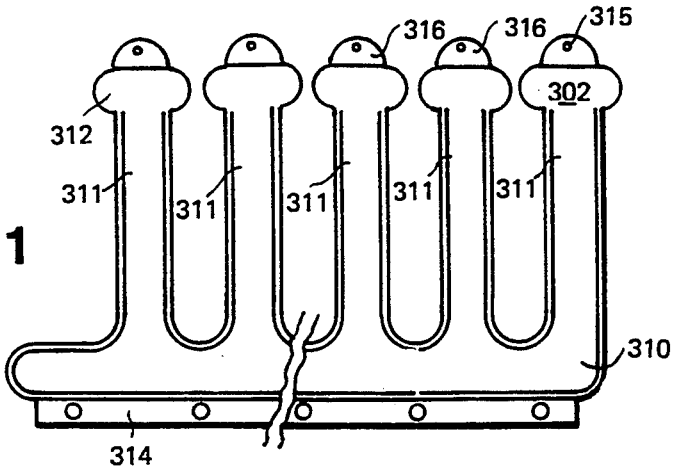
FIG. 11 is a transverse sectional view of FIG. 10.
Figure 12:
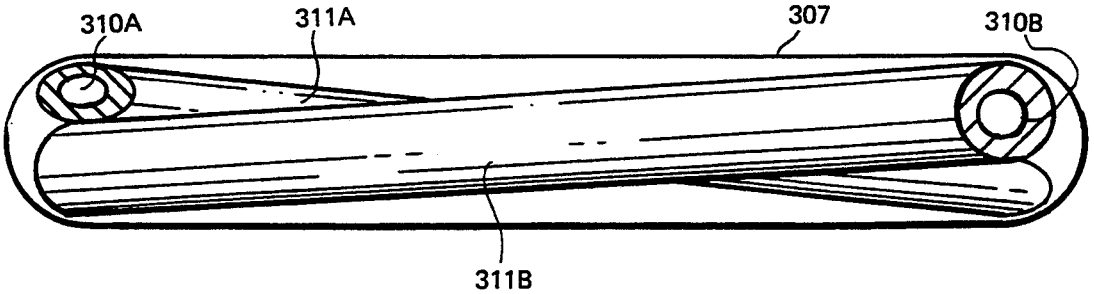
FIG. 12 is a detail showing one set of tubes from the arrangement of FIG. 9.

The sheets from which the tubes are formed are high frequency welded so as to form a flap 314 along the margin of the main tube 310 remote from the branch tubes 311 and a terminal flap 315 at the closed end of each branch tube 311. Press fasteners 316 are provided on the flaps so that two of the arrangements shown in FIG. 9 may be interwoven as shown in FIG. 10 and the press fasteners then engage complementary fasteners present on the cover sidewall or support which is not shown.

The arrangement of tubes produces a shallow "V" shape between the transverse tubes. This spreads the contact areas so reducing the pressure and increasing the patient's comfort. The presence of the shallow shape is enhanced because of the wider ends 312 of the branch tubes.

The connectors 313 connect the main tubes 310A to the pump and control unit 316 via the air hoses 315. Pneumatic pressure produced by the pump is alternately applied to the main tube 310 and then relieved so alternately inflating and deflating the main tubes and the associated branch tubes 311.

Figure 13A:
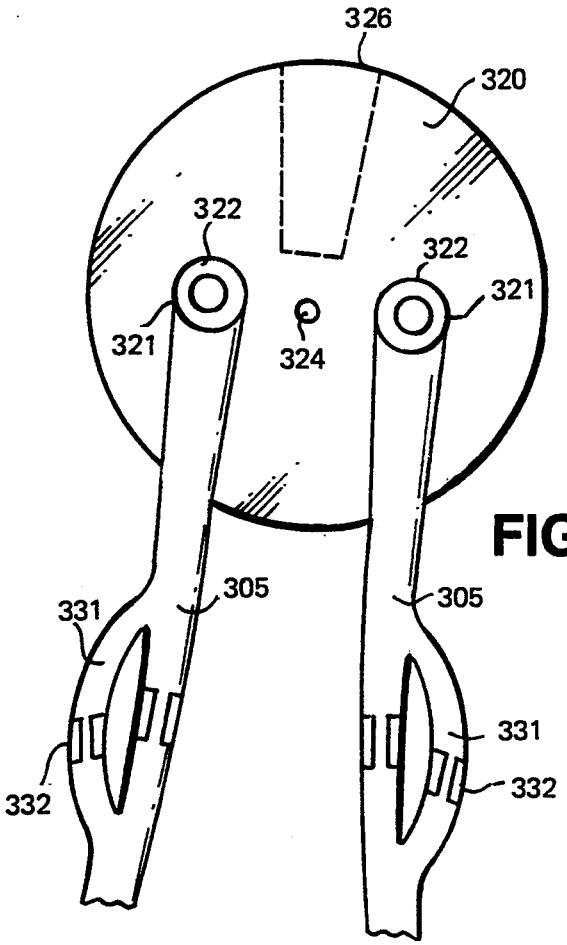
FIG. 13A is an enlarged plan view of the pump valve for the chair of FIG. 8.
Figure 13B:
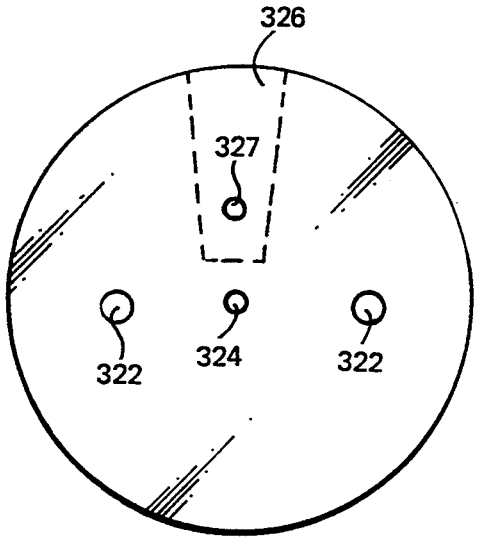
FIG. 13B is an enlarged plan view of the pump valve for the chair of FIG. 8.
Figure 13C:
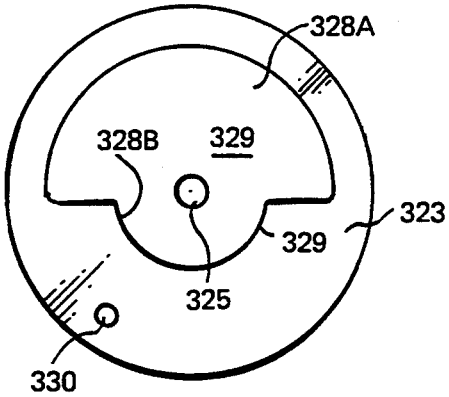
FIG. 13C is an enlarged plan view of the pump valve for the chair of FIG. 8.

The pump unit contains a valve unit shown in FIGS. 13A to 13C. The air hose 315 extends from the connectors 313 of each chamber to a part 321 in the outer side of a fixed block 320 within the pump unit (FIG. 13A). The hose 315 is threadingly connected to the threaded inner wall of the port 321. The inner face of the port 321 (FIG. 13B) has a relatively small diameter hole 322. Behind the fixed block 320 is a rotary block 323 the inside face of which is shown in FIG. 13C. The fixed block 320 and the rotary block 323 are mounted on a common spindle, not shown, passing through aligned holes 324, 325. A main air supply extends from an inlet 326 in the top of the block 320 and emerges at a small diameter hole 327 above the spindle hole 324.

The inside face of the rotary block 323 has a depression in the form of an upper large semi-circle 328A above a smaller semi-circle 328B. Shoulders 329 are formed in between. When the rotary block 323 rotates relative to the fixed block 320, the major semi-circle 328A is brought into line with holes 322 and air can pass through both ports 321 whereas when the block has rotated further one port 321 will be open and the other will be blocked off (by a shoulder 329). A small bleed hole 330 is present in the wall of the rotary block 323. By virtue of the dimensions of the semi circles 328A, 328B and the defined shoulder 329 the ports 321 are opened and closed according to the rotation of the rotary block 323, so allowing pressurised air to pass into a selected port or to block off that port or to allow air to pass between the ports or to allow pressurised air to escape via the bleed hole 330.

As shown in FIG. 13A the hoses each incorporate a loop line 331 containing a flow restrictor 332. The main line 305 contains a one way valve 333. The pump is of a low rating, and arranged to deliver at maximum flow rate about 6 liters of air per minute. The pressure will be adjustable from about 5 psi down. The valve unit is arranged so that the pump will deliver pressured air at about 1 to 1.5 psi into the air hoses 305. The air is delivered so as to inflate one set of tubes 310, 311 at a time when the other will be deflating. The rotation of the rotary block 323 controls the flow of air into and from the air hose. Consider the two hoses as A and B. When the major semi-circle 328A has rotated to allow the passage of air into one port 322 the associated hose A will start to inflate and after the short time interval, perhaps 30 seconds, hose B will start to deflate. As the rotary block rotates further hose A will stop inflating and hose B will start inflating followed by hose A deflating and hose B continuing to inflate. This arrangement ensures that there is sufficient air in the tube to provide comfort to the patient even though deflation is taking place. Because of the presence of the semicircles 328A, 328B on the inside face of the rotary block 323 at a particular moment in time pressurised air from a deflating hose could flow across the rotary block 323 into the hose that is inflating. To reduce this risk the air hose 305 incorporates the loop 331 having the restricting valve 332 so that the rate of deflation becomes substantially equal to the rate of inflation.

As shown in FIG. 1, the chair pad includes separate arm pads 307. These are the same as the pads of the back portion or seat portion as appropriate. Hoses 308 the same as hoses 305 lead to the pump and valve unit 306. The arm pads operate in the same way as the rest of the chair pad, and assist blood circulation in the arms of the patient.

It is claimed:

1. A pad for providing alternating pressure e.g. in a mattress, comprising: first and second flexible longitudinal tubes adjacent respective first and second sides of the pad; a plurality of first transverse tubes communicating pneumatically with the first longitudinal tube and each having a closed end remote therefrom; and a plurality of second transverse tubes communicating pneumatically with the second longitudinal tube and each having a closed end remote therefrom, the first tubes being disposed at a first angle such that the closed ends of the first transverse tubes are located beneath the second longitudinal tube, and the closed ends of the second transverse tubes being disposed at a second angle opposite to the first angle are located beneath the first longitudinal tube, whereby the first and second tubes are interdigitated so that the arrangement produces a shallow "V".

2. A pad as claimed in claim 1, including two layers of said first and second longitudinal and transverse tubes arranged one above the other so that each first tube in the upper layer lies directly over a respective second tube in the lower layer and each second tube in the upper layer lies directly over a first tube in the lower layer.

3. A pad as claimed in claim 2, in which the closed ends of the transverse tubes are of increased diameter.

4. A pad as claimed in claim 1, in which pressure sensitive means are present, the means comprising a sealed body having an air path, pressurised air being supplied to the air path, and means to direct the pressurised air from the air path to the tubes in the event of a constriction in the air path.

5. A pad as claimed in claim 4, in which a pipe leads from the air path to the exterior of the pad.

6. A pad as claimed in claim 4, in which a pipe leads from the air path of each layer to a common exit conduit.

7. A pad for use by a patient sitting in a chair, the pad comprising a seat portion and a back portion to overlie the seat and back portion of the chair respectively, the pad, comprising: first and second flexible longitudinal tubes adjacent respective first and second sides of the pad; a plurality of first transverse tubes communicating pneumatically with the first longitudinal tube and each having a closed end remote therefrom; and a plurality of second transverse tubes communicating pneumatically with the second longitudinal tube and each having a closed end remote therefrom, the first tubes being disposed at a first angle such that the closed ends of the first transverse tubes are located beneath the second longitudinal tube, and the closed ends of the second transverse tubes being disposed at an angle opposite to the first angle, are located beneath the first longitudinal tube, whereby the first and second tubes are interdigitated so that the arrangement provides a shallow "v".

8. A pad as claimed in claim 7, comprising two sets of chambers interspaced with one another, in association with a pump and control apparatus for alternately inflating and at least partly deflating the chamber of one set while simultaneously alternately at least partly deflating the chambers of the other set.

9. A pad as claimed in claim 7, in which the size of the chambers in the seat portion is different from that of the back portion.

10. A pad as claimed in claim 7, for use with a chair with arm rests, the pad including side portions to overlie the arm rests of the chair.

* * * * *